US011550263B2

(12) United States Patent
Charbon

(10) Patent No.: US 11,550,263 B2
(45) Date of Patent: Jan. 10, 2023

(54) METHOD FOR MANUFACTURING A BALANCE SPRING FOR A HOROLOGICAL MOVEMENT

(71) Applicant: Nivarox-FAR S.A., Le Locle (CH)

(72) Inventor: Christian Charbon, Chezard-St-Martin (CH)

(73) Assignee: Nivarox-FAR S.A., Le Locle (CH)

( * ) Notice: Subject to any disclaimer, the term of this patent is extended or adjusted under 35 U.S.C. 154(b) by 371 days.

(21) Appl. No.: 16/831,913

(22) Filed: Mar. 27, 2020

(65) Prior Publication Data

US 2020/0356057 A1 Nov. 12, 2020

(30) Foreign Application Priority Data

May 7, 2019 (EP) ..... 19173114

(51) Int. Cl.
*G04B 17/06* (2006.01)

(52) U.S. Cl.
CPC ..... *G04B 17/066* (2013.01); *G04B 17/063* (2013.01)

(58) Field of Classification Search
CPC ..... G04B 17/066; G04B 17/063; G04B 17/06
See application file for complete search history.

(56) References Cited

U.S. PATENT DOCUMENTS 5,881,026 A 3/1999 Baur et al.
10,795,317 B2 * 10/2020 Charbon ..... C21D 9/02
2002/0180130 A1 12/2002 Baur et al.
2007/0133355 A1 * 6/2007 Hara ..... G04B 1/145 368/140
2015/0185701 A1 * 7/2015 Tobenas Borron ..... C23C 16/40 427/419.7

(Continued)

FOREIGN PATENT DOCUMENTS

EP 0 886 195 A1 12/1998
EP 1 258 786 A1 11/2002

(Continued)

OTHER PUBLICATIONS

Japanese Office Action dated Jan. 19, 2021 in Japanese Patent Application No. 2020-068864 (with English translation), 18 pages.

(Continued)

*Primary Examiner* — Sean Kayes
(74) *Attorney, Agent, or Firm* — Oblon, McClelland, Maier & Neustadt, L.L.P.

(57) ABSTRACT

A method for manufacturing a balance spring intended to equip a balance of a horological movement, including a step of producing a blank made of a niobium and hafnium alloy including between 5 and 60 wt %, preferably between 5 and 30 wt %, and more preferably between 8 and 12 wt % hafnium, a step of annealing and cooling the blank, at least one step of deforming the annealed blank in order to form a wire. The method includes, before the deformation step, a step of depositing, on the blank, a layer of a ductile material chosen from the group consisting of copper, nickel, cupronickel, cupro-manganese, gold, silver, nickel-phosphorus Ni—P and nickel-boron Ni—B, in order to facilitate the wire shaping operation. A balance spring can be produced by the manufacturing method.

12 Claims, 1 Drawing Sheet

(56) References Cited

U.S. PATENT DOCUMENTS

| | | | | |
|---|---|---|---|---|
| 2015/0241847 | A1* | 8/2015 | Hirai | G04B 17/06 368/175 |
| 2017/0351216 | A1* | 12/2017 | Balague | G04B 17/066 |
| 2018/0373202 | A1* | 12/2018 | Charbon | C22C 14/00 |

FOREIGN PATENT DOCUMENTS

| | | | |
|---|---|---|---|
| JP | 11-71625 | A | 3/1999 |
| JP | 2003-4866 | A | 1/2003 |
| JP | 2019-7955 | A | 1/2019 |

OTHER PUBLICATIONS

Combined Chinese Office Action and Search Report dated Mar. 25, 2021 in corresponding Chinese Patent Application No. 202010372078.1 (with English Translation and English Translation of Category of Cited Documents), 9 pages.

European Search Report dated Oct. 24, 2019 in European Application 19173114.0 filed on May 7, 2019 (with English Translation of Categories of Cited Documents), 4 pages.

* cited by examiner

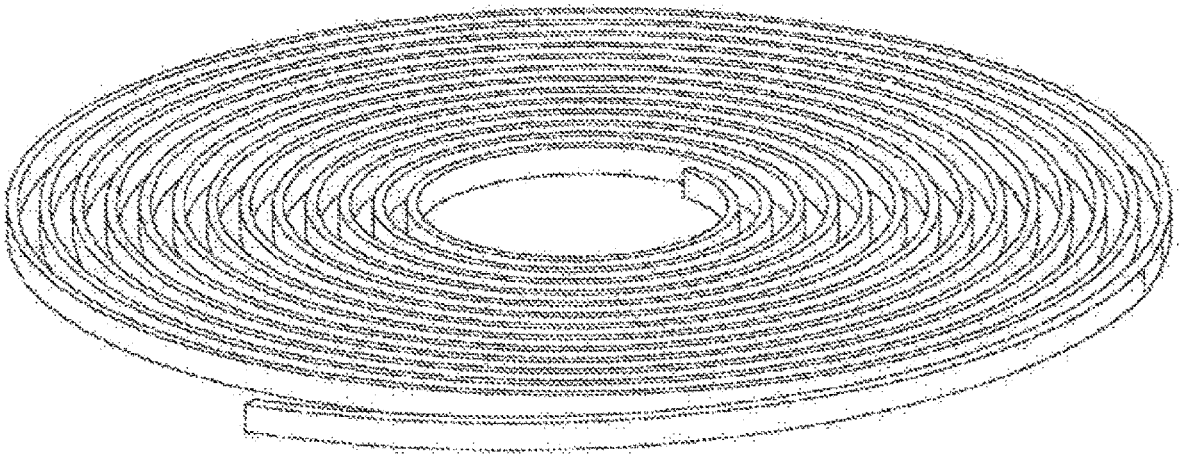

METHOD FOR MANUFACTURING A BALANCE SPRING FOR A HOROLOGICAL MOVEMENT

CROSS-REFERENCE TO RELATED APPLICATION

This application claims priority to European Patent Application No. 19173114.0 filed on May 7, 2019, the entire disclosure of which is hereby incorporated herein by reference.

FIELD OF THE INVENTION

The invention relates to a method for manufacturing a balance spring intended to equip a balance of a horological movement. It further relates to a balance spring produced using this method made from a Nb—Hf alloy.

BACKGROUND OF THE INVENTION

The manufacture of balance springs for horology is subject to restrictions that often appear irreconcilable at first sight:

- the need to obtain a high yield strength,
- an ease of manufacture, particularly of wire drawing and rolling operations,
- an excellent fatigue strength,
- stability of performance levels over time,
- small cross-sections.

The production of balance springs is furthermore focused on concern for temperature compensation, in order to guarantee consistent chronometric performance levels. This requires obtaining a thermoelastic coefficient that is close to zero. Balance springs with limited sensitivity to magnetic fields are also sought.

Balance springs have been developed using niobium and hafnium alloys. However, these alloys pose problems involving sticking and seizing in the drawing or wire drawing drawplates (diamond or hard metal) and against the rolling rollers (hard metal or steel), which makes it virtually impossible to transform them into fine wires using the standard methods used for steel for example.

Any improvement on at least one of these points, and in particular on the ease of manufacture, particularly wire drawing and rolling operations, thus represents significant progress.

SUMMARY OF THE INVENTION

One purpose of the present invention is to propose a method for manufacturing a balance spring intended to equip a balance of a horological movement that facilitates deformations, and more particularly makes for easy rolling operations.

To this end, the invention relates to a method for manufacturing a balance spring intended to equip a balance of a horological movement, comprising:

- a step of producing a blank made of a niobium and hafnium alloy containing:
  - niobium: the remainder to 100 wt %,
  - hafnium: between 5 and 60 wt %, preferably between 5 and 30 wt %, and more preferably between 8 and 12 wt %,
  - one or more elements selected from Ti, Zr, Ta and W, the percentage of each element lying in the range 0 to 2 wt %, preferably in the range 0.2 to 1.5 wt %,
  - impurities, the total percentage whereof lies in the range 0 to 0.5 wt %. More specifically, the impurities can be traces of elements selected from the group consisting of O, H, C, Fe, N, Ni, Si, Cu, Al, Cr, Mn, V, Sn, Mg, Mo, Pb, Co and B, each of said elements being present in a quantity that lies in the range 0 to 1,000 ppm by weight,
- a step of annealing and cooling said blank followed by a step of deforming the annealed blank to form a wire, which annealing and deformation steps can be repeated several times,
- a winding step for forming the balance spring,
- a final heat treatment step.

According to the invention, the method comprises, before the deformation step and after the annealing step, a step of depositing, on the blank, a layer of a ductile material chosen from the group consisting of copper, nickel, cupronickel, cupro-manganese, gold, silver, nickel-phosphorus Ni—P and nickel-boron Ni—B, in order to facilitate the wire shaping operation. Preferentially, the thickness of the ductile material layer deposited is chosen such that the ratio of the area of ductile material to the area of NbHf alloy for a given wire cross-section is less than 1, preferably less than 0.5, and more preferably lies in the range 0.01 to 0.4.

Such a manufacturing method facilitates the shaping of the NbHf alloy blank into a wire, and more specifically facilitates the drawing, wire drawing and rolling operations. In particular, this method facilitates the manufacture of a balance spring having the following composition:

- niobium: the remainder to 100 wt %,
- hafnium: between 5 and 15 wt %, preferably between 8 and 12 wt %,
- one or more elements selected from Ti, Zr, Ta, and W, the percentage of each element lying in the range 0.2 to 1.5 wt %,
- impurities, the total percentage whereof lies in the range 0 to 0.5 wt %.

BRIEF DESCRIPTION OF THE DRAWING

The FIGURE shows one example of a balance spring for a horological movement.

DESCRIPTION OF THE INVENTION

The invention relates to a method for manufacturing a balance spring intended to equip a balance of a horological movement and made of an alloy containing niobium and hafnium.

The method comprises the following steps:

- a step of producing a blank made of a niobium and hafnium alloy containing:
  - niobium: the remainder to 100 wt %,
  - hafnium: between 5 and 60 wt %, preferably between 5 and 30 wt %, and more preferably between 8 and 12 wt %,
  - one or more elements selected from Ti, Zr, Ta and W, the percentage of each element lying in the range 0 to 2 wt %, preferably in the range 0.2 to 1.5 wt %,
  - impurities, the total percentage whereof lies in the range 0 to 0.5 wt %. More specifically, the impurities can be traces of elements selected from the group consisting of O, H, C, Fe, N, Ni, Si, Cu, Al, Cr, Mn, V, Sn, Mg, Mo, Pb, Co and B, each of said elements being present in a quantity that lies in the range 0 to 1,000 ppm by weight,
- a step of annealing said blank, followed by cooling said blank, a step of depositing a ductile material on the blank, at least one step of deforming the blank to form a wire, with an annealing and cooling step between the deformation steps in the case of a plurality of deformation steps, a winding step for forming the balance spring, a final heat treatment step allowing the shape of the balance spring to be fixed and the thermoelastic coefficient to be adjusted.

In a particularly preferred manner, the blank comprises between 8 and 12 wt % hafnium, Ti, Zr, Ta and W, the percentage of each element lying in the range 0.2 to 1.5 wt %, and more preferably Ti, the percentage whereof lies in the range 0.5 to 1.5 wt %, Zr, the percentage whereof lies in the range 0.5 to 0.9 wt %, Ta, the percentage whereof lies in the range 0.3 to 0.7 wt %, and W, the percentage whereof lies in the range 0.3 to 0.7 wt %.

Preferentially, the NbHf alloy blank used in the present invention does not comprise any other elements except any potential and unavoidable traces. This allows the formation of brittle phases to be prevented.

More particularly, the oxygen content is less than or equal to 0.10 wt % of the total composition, in particular less than or equal to 0.05 wt % of the total composition, or even less than or equal to 0.03 wt % of the total composition.

More particularly, the carbon content is less than or equal to 0.04 wt % of the total composition, in particular less than or equal to 0.02 wt % of the total composition, or even less than or equal to 0.015 wt % of the total composition.

More particularly, the iron content is less than or equal to 0.05 wt % of the total composition, in particular less than or equal to 0.02 wt % of the total composition, or even less than or equal to 0.005 wt % of the total composition.

More particularly, the nitrogen content is less than or equal to 0.04 wt % of the total composition, in particular less than or equal to 0.02 wt % of the total composition, or even less than or equal to 0.015 wt % of the total composition.

More particularly, the hydrogen content is less than or equal to 0.01 wt % of the total composition, in particular less than or equal to 0.0035 wt % of the total composition, or even less than or equal to 0.001 wt % of the total composition.

More particularly, the silicon content is less than or equal to 0.05 wt % of the total composition, in particular less than or equal to 0.02 wt % of the total composition, or even less than or equal to 0.005 wt % of the total composition.

More particularly, the nickel content is less than or equal to 0.05 wt % of the total composition, in particular less than or equal to 0.01 wt % of the total composition, or even less than or equal to 0.002 wt % of the total composition.

More particularly, the content of an element in a ductile solid solution, such as copper, in the alloy, is less than or equal to 0.05 wt % of the total composition, in particular less than or equal to 0.01 wt % of the total composition, or even less than or equal to 0.004 wt % of the total composition.

More particularly, the aluminium content is less than or equal to 0.05 wt % of the total composition, in particular less than or equal to 0.01 wt % of the total composition, or even less than or equal to 0.002 wt % of the total composition.

More particularly, the chromium content is less than or equal to 0.05 wt % of the total composition, in particular less than or equal to 0.01 wt % of the total composition, or even less than or equal to 0.002 wt % of the total composition.

More particularly, the manganese content is less than or equal to 0.05 wt % of the total composition, in particular less than or equal to 0.01 wt % of the total composition, or even less than or equal to 0.002 wt % of the total composition.

More particularly, the vanadium content is less than or equal to 0.05 wt % of the total composition, in particular less than or equal to 0.01 wt % of the total composition, or even less than or equal to 0.002 wt % of the total composition.

More particularly, the tin content is less than or equal to 0.01 wt % of the total composition, in particular less than or equal to 0.0035 wt % of the total composition, or even less than or equal to 0.001 wt % of the total composition.

More particularly, the magnesium content is less than or equal to 0.05 wt % of the total composition, in particular less than or equal to 0.01 wt % of the total composition, or even less than or equal to 0.002 wt % of the total composition.

More particularly, the molybdenum content is less than or equal to 0.05 wt % of the total composition, in particular less than or equal to 0.01 wt % of the total composition, or even less than or equal to 0.002 wt % of the total composition.

More particularly, the lead content is less than or equal to 0.05 wt % of the total composition, in particular less than or equal to 0.01 wt % of the total composition, or even less than or equal to 0.002 wt % of the total composition.

More particularly, the cobalt content is less than or equal to 0.01 wt % of the total composition, in particular less than or equal to 0.0035 wt % of the total composition, or even less than or equal to 0.001 wt % of the total composition.

More particularly, the boron content is less than or equal to 0.005 wt % of the total composition, in particular less than or equal to 0.0001 wt % of the total composition.

The annealing step is a dissolving treatment, with a duration that preferably lies in the range 5 minutes to 2 hours at a temperature that lies in the range 650° C. to 1,750° C., in a vacuum, followed by quenching, for example in a gas to obtain a supersaturated solid solution of Hf in β-phase Nb. According to an alternative embodiment, natural cooling in a vacuum can also be considered.

The deposition step that more particularly forms the object of the invention consists of depositing a layer of a ductile material chosen from the group consisting of copper, nickel, cupronickel, cupro-manganese, gold, silver, nickel-phosphorus Ni—P and nickel-boron Ni—B, in order to facilitate the wire shaping operation. Preferentially, the thickness of the ductile material layer deposited is chosen such that the ratio of the area of ductile material to the area of NbHf alloy for a given wire cross-section is less than 1, preferably less than 0.5, and more preferably lies in the range 0.01 to 0.4. By way of example, for a total wire diameter of 0.1 mm, the layer of ductile material can have a thickness of 7 μm for a cross-section of NbHf alloy of 0.086 mm in diameter. This corresponds to a ratio of the area of copper (0.002 $mm^2$) to the area of NbHf (0.0058 $mm^2$) of 0.35.

Such a thickness of ductile material, and in particular of copper, makes it possible to easily draw, wire draw and roll the composite Cu/NbHf material. More specifically, the copper thickness is optimised such that the point, created by filing or by hot drawing, required for the insertion of the wire into the drawplate during drawing or wire drawing operations, is coated in copper.

The ductile material, preferably copper, is thus deposited at a given time to facilitate the wire shaping operation by drawing, wire drawing and rolling, so that a thickness remains that preferably lies in the range 1 to 500 micrometres on the wire, which has a total diameter of 0.2 to 1 millimetre.

The addition of ductile material can be galvanic, by PVD or CVD, or mechanical; in this case it is a sleeve or a tube of ductile material such as copper, which is adjusted on a NbHf alloy bar with a large diameter, which is then thinned out during the one or more steps of deforming the composite bar. Thus, one possibility involves forming a composite billet by assembling a Nb—Hf bar and a copper sleeve which is then extruded.

The deformation step as a whole denotes one or more deformation treatments, which can comprise wire drawing and/or rolling. Wire drawing can require the use of one or more drawplates in the same deformation step or in different deformation steps if necessary. Wire drawing is carried out until a wire having a round cross-section is obtained. Rolling can be carried out during the same deformation step as wire drawing, or in another subsequent deformation step. Advantageously, the last deformation treatment applied to the alloy is a rolling operation, preferably having a rectangular profile that is compatible with the inlet cross-section for a winder spindle.

The method can include one or more deformation steps with a deformation ratio for each step that lies in the range 1 to 5, preferably in the range 2 to 5, the deformation ratio satisfying the conventional formula 2 ln(d0/d) where d0 and d are the diameter before and after deformation respectively. The total deformation ratio can lie in the range 1 to 14.

The method can include intermediate annealing steps between the different deformation steps.

The method of the invention preferentially comprises, after the deformation step, a step of eliminating said layer of ductile material. Preferably, the ductile material is eliminated once all deformation operations have been carried out, i.e. after the final rolling operation, before the winding operation. However, this does not rule out removing the layer of ductile material before having finalised all deformation operations. Thus, when rolling in a plurality of stages, the layer of ductile material can be eliminated before the final rolling stage. Preferably, the layer of ductile material, such as copper, is removed from the wire in particular by etching with a cyanide-based or acid-based solution, for example nitric acid.

Annealing prior to the deformation step, in addition to the intermediate annealing operations carried out between the deformation steps, is carried out for a duration that lies in the range 5 minutes to 2 hours, preferably in the range 10 minutes to 1 hour, at a temperature that lies in the range 650° C. to 1,750° C.

The final heat treatment after winding is carried out at a temperature that lies in the range 500 to 1,250° C. for a duration that lies in the range 30 minutes to 30 hours. Depending on the composition of the alloy and the temperatures, a single-phase structure of the body-centred cubic type or two-phase structure with a body-centred cubic structure and a hexagonal close-packed structure can be obtained at the end of this heat treatment.

The method of the invention allows for the production, and more particularly the shaping, of a balance spring for a balance made of a niobium-hafnium type alloy. This alloy has high mechanical properties, by combining a very high yield strength, greater than 600 MPa, and a very low modulus of elasticity, in the order of 60 GPa to 100 GPa. This combination of properties is well suited to a balance spring. Moreover, such an alloy is paramagnetic.

A binary-type alloy containing niobium and hafnium, of the type selected hereinabove for implementing the invention, also has a similar effect to that of "Elinvar", with a thermoelastic coefficient of virtually zero in the usual operating temperature range for watches, and suitable for the manufacture of self-compensating balance springs.

The invention claimed is:

1. A method for manufacturing a balance spring intended to equip a balance of a horological movement, comprising:

a step of producing a blank made of a niobium and hafnium alloy containing:

niobium: the remainder to 100 wt %, hafnium: between 8 and 12 wt %, one or more elements selected from Ti, Zr, Ta and W, the percentage of each element lying in the range 0 to 2 wt %, impurities, the total percentage whereof lies in the range 0 to 0.5 wt %, a step of annealing and cooling the blank, at least one step of deforming the annealed blank in order to form a wire, a winding step for forming the balance spring, a final step of heat treating the balance spring, wherein said method comprises, before the deformation step, a step of depositing, on the blank, a layer of a ductile material chosen from the group consisting of copper, nickel, cupronickel, cupro-manganese, gold, silver, nickel-phosphorus Ni—P and nickel-boron Ni—B, in order to facilitate the wire shaping operation.

2. The method according to claim 1, wherein the thickness of the ductile material layer deposited is chosen such that the ratio of the area of ductile material to the area of the alloy for a given wire cross-section is less than 1.

3. The method according to claim 1, wherein said method comprises, before the winding step, a step of eliminating said layer of ductile material.

4. The method according to claim 1, wherein the deformation step is carried out by wire drawing and/or rolling.

5. The method according to claim 1, wherein said method includes one or more deformation steps with, for each step, a deformation carried out with a deformation ratio that lies in the range 1 to 5, the total cumulation of the deformations over all of the steps producing a total deformation ratio that lies in the range 1 to 14.

6. The method according to claim 5, wherein it includes an annealing and cooling step between the deformation steps.

7. The method according to claim 1, wherein each annealing and cooling step is a dissolving treatment, with a duration that lies in the range 5 minutes to 2 hours at a temperature that lies in the range 650° C. to 1,750° C., in a vacuum, followed by quenching, in a gas or by natural cooling in a vacuum, to obtain a supersaturated solid solution of Hf in Nb.

8. The method according to claim 1, wherein the final heat treatment step is carried out for a duration that lies in the range 30 minutes to 30 hours at a temperature that lies in the range 500° C. to 1,250° C.

9. The method according to claim 1, wherein said niobium and hafnium alloy contains one or more elements selected from Ti, Zr, Ta and W, the percentage of each element lying in the range 0.2 to 1.5 wt %.

10. A balance spring intended to equip a balance of a horological movement, the balance spring being made of a niobium and hafnium alloy containing:

niobium: the remainder to 100 wt %, hafnium: between 8 and 12 wt %, one or more elements selected from Ti, Zr, Ta, and W, the percentage of each element lying in the range 0.2 to 1.5 wt %, impurities, the total percentage whereof lies in the range 0 to 0.5 wt %.

11. The balance spring according to claim 10, wherein said balance spring comprises Ti, Zr, Ta, and W, the weight percentage of each element lying in the range 0.2 to 1.5 wt %.

12. The balance spring according to claim 11, wherein the weight percentage of Ti lies in the range 0.5 to 1.5 wt %, the weight percentage of Zr lies in the range 0.5 to 0.9 wt %, the weight percentage of Ta lies in the range 0.3 to 0.7 wt %, and the weight percentage of W lies in the range 0.3 to 0.7 wt %.

* * * * *